US006408735B1

(12) United States Patent
Harvey et al.

(10) Patent No.: US 6,408,735 B1
(45) Date of Patent: Jun. 25, 2002

(54) ACTUATOR

(75) Inventors: John H Harvey, Wolverhampton; Timothy Hudson, Telford, both of (GB)

(73) Assignee: Lucas Industries Limited (GB)

( * ) Notice: Subject to any disclaimer, the term of this patent is extended or adjusted under 35 U.S.C. 154(b) by 0 days.

(21) Appl. No.: 09/573,896

(22) Filed: May 18, 2000

(30) Foreign Application Priority Data

May 19, 1999 (GB) ..... 9911526

(51) Int. Cl.[7] ..... F01B 7/20
(52) U.S. Cl. ..... 91/51; 92/163; 92/248
(58) Field of Search ..... 92/163, 259, 248, 92/85 B, 5 R; 91/47, 49, 51, 417 R, 402

(56) References Cited

U.S. PATENT DOCUMENTS 2,877,070 A * 3/1959 Lee ..... 277/448
3,382,769 A * 5/1968 Raider ..... 92/163
3,472,125 A * 10/1969 Noble ..... 92/163
3,636,824 A * 1/1972 Clark ..... 277/468
5,725,221 A * 3/1998 Pekarsky ..... 277/589
6,250,612 B1 * 6/2001 Doll ..... 92/5 R

* cited by examiner

*Primary Examiner*—F. Daniel Lopez
*Assistant Examiner*—Igor Kershteyn
(74) *Attorney, Agent, or Firm*—Andrus, Sceales, Starke & Sawall

(57) ABSTRACT

An actuator having a piston member slideable within a cylinder, the piston member defining with the cylinder a first chamber and a second chamber, the effective cross-sectional of the piston member exposed to the fluid pressure within the first chamber being greater than that exposed to the fluid pressure within the second chamber. The actuator further has first and second ports through which fluid can be supplied to the first and second chambers, respectively, and a third port located intermediate the first and second ports. The piston member and the third port are cooperable to throttle the rate at which fluid is able to escape from the first and second chambers through the third port, in use.

20 Claims, 7 Drawing Sheets

ACTUATOR

FIELD OF THE INVENTION

This invention relates to an actuator, and in particular to an actuator of the type known as a hole in the wall (HITW) actuator.

BACKGROUND OF THE INVENTION

FIG. 1 illustrates, diagrammatically, a typical HITW actuator which comprises a housing defining a cylinder 1 within which a piston 2 is slidable. The piston 2 divides the cylinder 1 into first and second chambers 3, 4, each of which communicates with a respective passage 5, 6. The passages 5, 6 are connected, in use, to an appropriate valve arrangement whereby the chambers 3, 4 are supplied with fluid under either low or high pressure. The effective area of the piston 2 exposed to the fluid pressure within the first chamber 3 is substantially equal to that exposed to the fluid pressure within the second chamber 4. It will be appreciated that by applying fluid under high pressure to one of the chambers and fluid under low pressure to the other of the chambers, the piston 2 can be moved to and held in an end position relative to the housing. By applying fluid under high pressure to a chamber which was at low pressure, and by venting the chamber which was at high pressure, the piston 2 can be moved to and held in an opposite end position.

A rod 8 is secured to the piston 2 such that movement of the piston 2 results in extension or retraction of the rod 8 relative to the housing.

Approximately mid way along the length of the cylinder 1, a third passage 7 known as a hole in the wall is provided. Depending upon the position of the piston 2, the third passage 7 can communicate with either the first chamber 3 or the second chamber 4 or may be closed by the piston 2.

In use, with the third passage 7 isolated from both the high and low pressure sources, the actuator operates as described hereinbefore. In a further mode of operation, the third passage 7 is connected to a source of fluid under low pressure, and both the first chamber 3 and the second chamber 4 are supplied with fluid under high pressure. With the piston 2 in its right hand position as shown, the fluid pressure within the first chamber 3 will be lower than that within the second chamber 4 as the third passage 7 communicates with the first chamber 3. As a result, the piston 2 will move towards the left, movement continuing until the piston 2 reaches a position in which it covers the third passage 7. When the third passage 7 is closed, the pressures within the first and second chambers 3, 4 become equal and so no net force is applied to the piston 2 by the fluid. Once this position is reached, all three connections to the cylinder 1 can be broken and the piston 2 will remain in this position. If the piston 2 and rod 8 are subject to buffeting, such buffeting forces will be absorbed by the fluid within the first and second chambers 3, 4 with very little movement of the piston 2 occurring.

SUMMARY OF THE INVENTION

According to the present invention there is provided an actuator comprising a piston slidable within a cylinder, the piston defining with the cylinder a first chamber and a second chamber, the effective cross-sectional area of the piston exposed to the fluid pressure within the first chamber being greater than that exposed to the fluid pressure within the second chamber, first and second ports whereby fluid can be supplied to the first and second chambers, respectively, and a third port located intermediate the first and second ports, the piston and the third port being cooperable to throttle the rate at which fluid is able to escape from the first and second chambers through the third port, in use.

In use, where the actuator is controlled in such a manner that the third port is connected to a source of fluid at relatively low pressure, the first and second ports being supplied with fluid at high pressure, the piston will move towards and be held in a position in which the third port communicates with the first chamber, the position of the piston being such that fluid is able to escape from the first chamber at a sufficiently high rate that the pressure within the first chamber is different from that within the second chamber, compensating for the difference in the effective areas of the piston exposed to the fluid pressures within the chambers and in the relatively high magnitude externally applied loads.

In order to achieve the necessary control over the rate at which fluid is able to escape from the first chamber, the piston is conveniently provided with a seal arrangement, forming a seal between the piston and the cylinder, the seal arrangement defining a metering edge which cooperates with the third port to throttle the rate of fluid flow to the third port. The metering edge is conveniently defined by part of a member carried by the piston and formed of aluminium bronze or PEEK.

BRIEF DESCRIPTION OF THE DRAWINGS

The invention will further be described, by way of example, with reference to the accompanying drawings, in which.

DETAILED DESCRIPTION OF THE INVENTION

Figure 2:
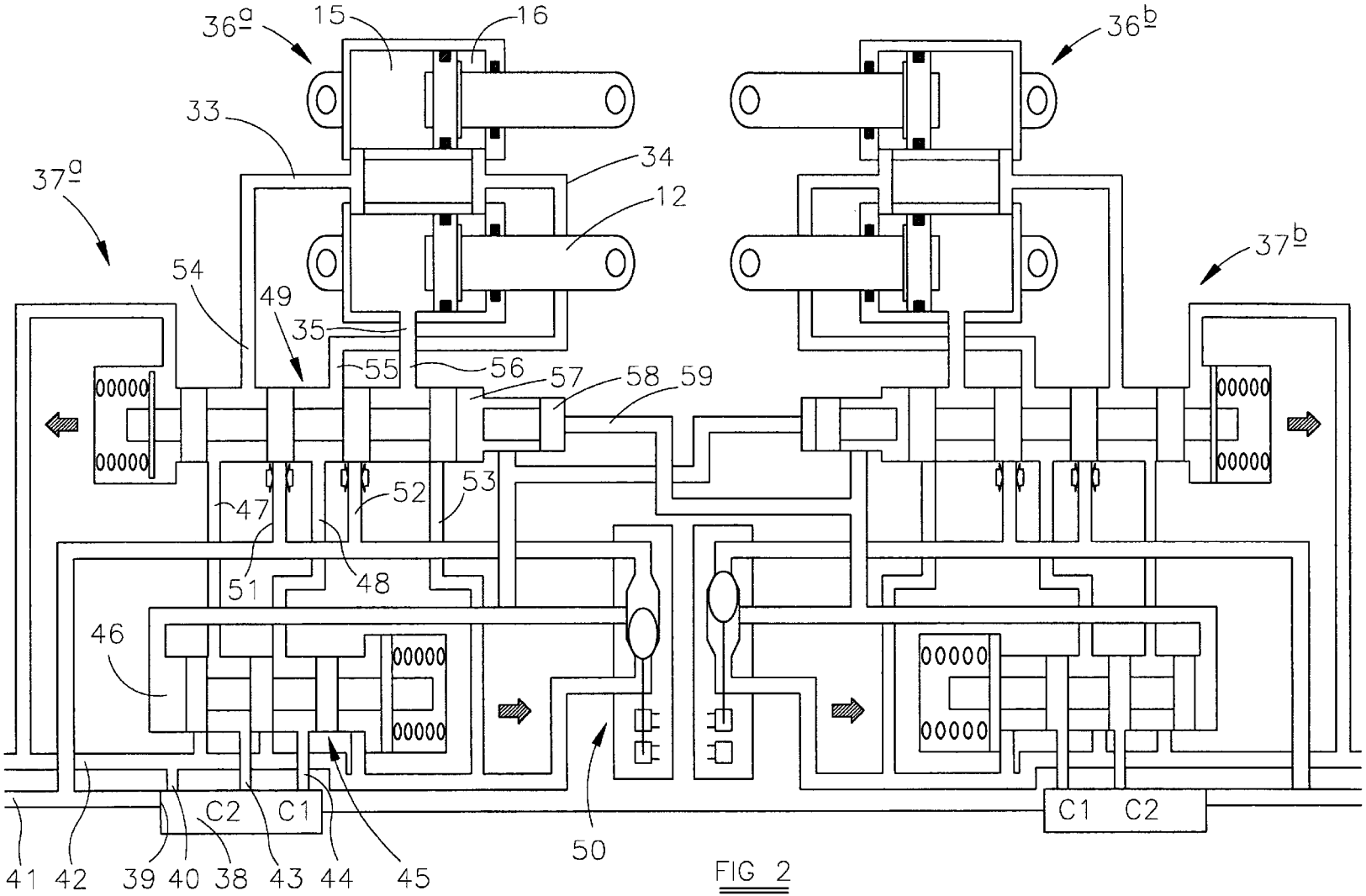
FIG. 2 is a diagrammatic view illustrating a pair of actuator control circuits arranged to operate in tandem and the associated actuators in accordance with an embodiment of the invention.
Figure 6:
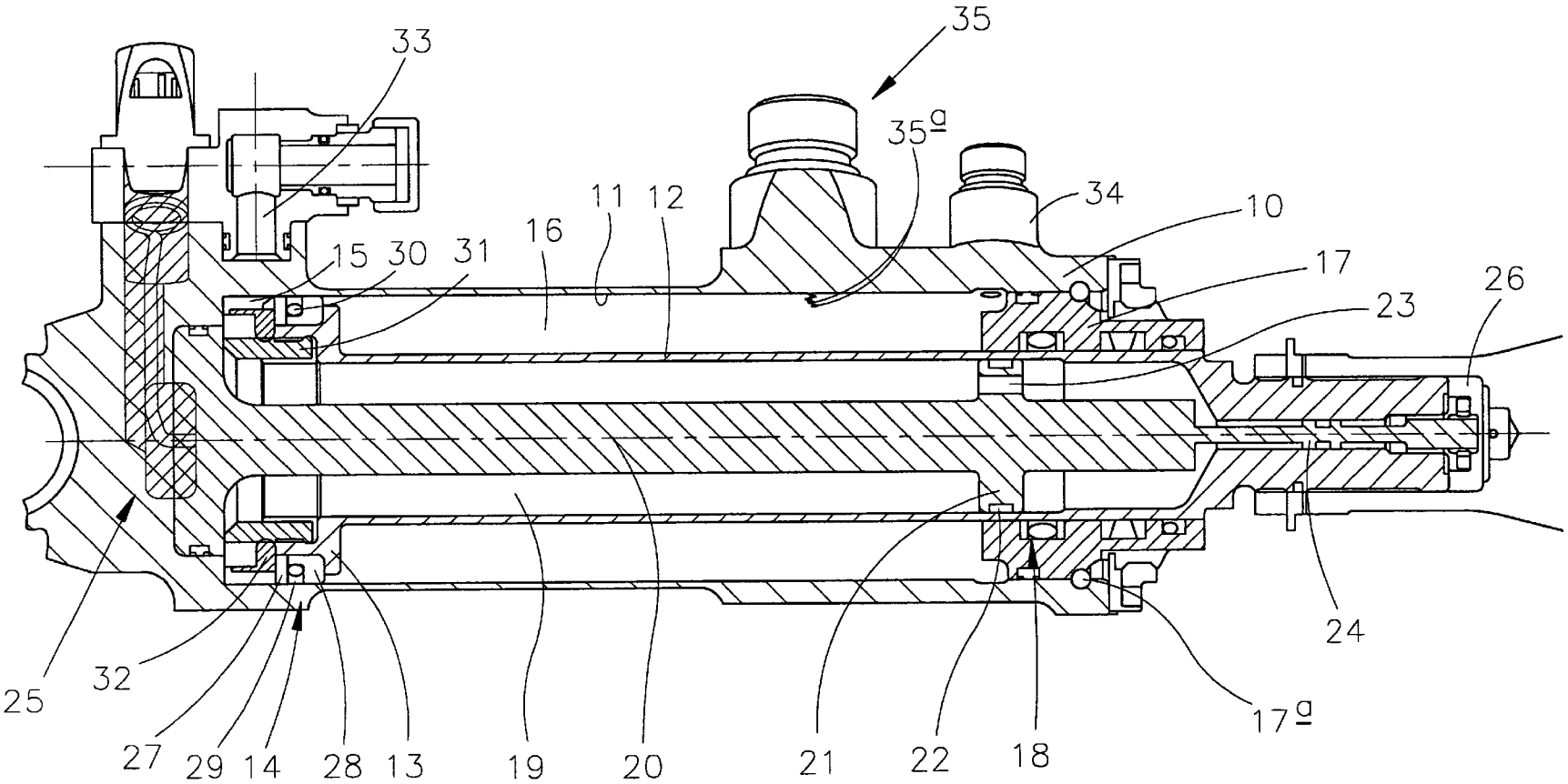
FIG. 6 is a sectional view illustrating part of the HITW actuator shown, diagrammatically, in FIGS. 2 to 5.

FIG. 2 illustrates a pair of control circuits for use in controlling the operation of four actuators of the type illustrated in greater detail in FIG. 6. As shown in FIG. 6, each actuator comprises a housing 10 within which a blind bore 11 is provided. A piston member 12 is slidable within the bore 11. The piston member 12 is of a diameter smaller than the bore 11, the piston member 12 including, at one end, an integral, outwardly extending flange 13, the outer edge of which carries a piston head seal arrangement 14 intended to form a fluid tight seal between the piston member 12 and the bore 11. It will be appreciated, therefore, that the piston member 12 divides the bore 11 into a first, left hand chamber 15 and a second, right hand chamber 16.

The open end of the bore 11 is closed by a plug 17 which is retained in the bore 11 by a ring 17*a* and which carries a seal member 18 arranged to form a seal between the plug 17 and the piston member 12 to avoid leakage from the second chamber 16.

The piston member 12 is of hollow form and defines an internal passage or chamber 19. An LVDT cylinder/coil assembly 20 is located within the chamber 19, the cylinder 20 being secured, at the blind end of the bore 11, to the housing 10. The cylinder 20 cooperates with an armature 24 which is secured to the piston member 12 and is slidable within a bore provided in the cylinder 20 to form a position sensor 25 which, in use, is used to monitor the position of the piston member 12, thus providing an indication regarding the axial position or length of the actuator. The cylinder 20 is shaped to define an outwardly extending flange 21 which carries, at its outer edge, a slide bearing member 22 which contacts the surface of the piston member 12 defining the chamber 19. It will be appreciated that the flange 21 divides the chamber 19 into two parts. The flange 19 is provided with a drilling 23 which provides a flow path between the two parts of the chamber 19 such that fluid can flow between the parts of the chamber 19, thus avoiding impeding movement of the piston member 12. The movement of the piston member 12 without corresponding changes in the output of the position sensor 25 may be used to provide an indication that a fault has occurred.

The housing 10 is provided with a formation permitting the housing to be secured to an aircraft body, the piston member 12 having secured thereto a mounting member 26 for use in securing the piston member 12 to a moveable part of the aircraft such that, upon operation of the actuator, the actuator moves the moveable part of the aircraft relative to the aircraft body.

The piston head seal arrangement 14 comprises a pair of annular members 27, 28 constructed of aluminium bronze alloy located within an annular recess defined adjacent an end of the piston member 12. The members 27, 28 together define a channel with which an elastomer seal member 30 is provided, an annular PEEK cap member 29 being located radially outward of the seal member 30 and arranged to engage the inner surface of the bore 11. The members 27, 28 are secured in position by a screw threaded member 31 which is secured to the piston member 12, a deformable cup locking washer 32 being located between the member 27 and the screw threaded member 31.

It will be appreciated that the effective area of the piston member 12 exposed to the fluid pressure within the first chamber 15 is substantially equal to the cross sectional area of the bore 11. The effective area of the piston member 12 exposed to the fluid pressure within the second chamber 16 is less than that exposed to the fluid pressure within the first chamber 15 by an amount substantially equal to the cross sectional area of the piston member 12 at the point at which it cooperates with the seal member 18.

The housing 10 is provided with first and second ports 33, 34 which communicate, respectively, with the first and second chambers 15, 16. A third port 35 is also provided, the third port 35 being located such that, depending upon the position of the piston member 12, the third port can communicate either with the first chamber 15 or with the second chamber 16. The third port 35 and the aluminium bronze members 27, 28 are designed such that, when the third port is connected to a low pressure fluid source with the first and second ports 33, 34 are connected to high pressure fluid sources, the third port 35 and members 27, 28 define therebetween a throttle arranged to control the rate at which fluid is able to escape from the first or second chambers 15, 16. To this end, the third port 35 opens into the bore 11 through a series of openings 35a which are spaced apart from one another in the direction of the axis of the bore As illustrated in FIG. 2, four such actuators are provided, the actuators being arranged in two banks, 36*a*, 36*b*, two of the actuators being provided in each bank. Each bank is controlled by a respective hydraulic control circuit 37*a*, 37*b*. The circuits are identical so only one of the circuits will be described in detail.

Each circuit comprises a servo valve 38 which has inlet ports 39, 40 connected, respectively, to a high pressure supply line 41 and a low pressure return line 42. The servo valve 38 further includes first and second outlet ports 43, 44. The servo valve 38 is operable to connect one of the outlet ports 43, 44 to the high pressure supply line 41 and the other to the return line 42.

The outlet ports 43, 44 of the selector valve 38 are connected to a by-pass spool valve 45 having a spool which is spring biased towards a position in which the connections to the outlet ports 43, 44 are blocked or closed by the spool. A surface of the spool is exposed to the fluid pressure within a control chamber 46 and arranged such that, when fluid under high pressure is applied to the control chamber 46, the spool is moved against the action of the spring biasing to the position shown in which the fluid supplied to the valve 45 from the outlet ports 43, 44 is able to flow to inlet ports 47, 48 of a HITW control valve 49. The valve 45 includes a pair of additional inlets which are connected to the return line 42 and which are located such that, when the spool occupies its rest position, the control chamber 46 being at low pressure, the additional inlets communicate with the inlet ports 47, 48 of the HITW control valve 49.

The fluid pressure applied to the control chamber 46 is controlled by an electromagnetically actuable three way solenoid valve 50 which is operable to connect the control chamber 46 to either the supply line 41 or the return line 42.

The HITW control valve 49 takes the form of a spool valve which includes a spool spring biased towards a position in which the inlet ports 47, 48 are closed. The HITW control valve 49 is provided with three additional inlet ports 51, 52, 53. Of these additional ports, two are of relatively small diameter and form restricted additional supply ports 51, 52 which are in constant communication with the supply line 41, the third being in constant communication with the return line 42 and forming an additional return port 53. The HITW control valve 49 further includes three outlet ports 54, 55, 56 which communicate, respectively, with the first, second and third ports 33, 34, 35 of the actuators associates with that control circuit. The spool is arranged such that, when the inlet ports 47, 48 are closed, the two additional supply ports 51, 52 communicate with the first and second outlet ports 54, 55 and the additional return port 53 communicates with the third outlet port 56. The spool is moveable against the spring biasing to close the three additional ports 51, 52, 53, and in these circumstances, the inlet ports 47, 48 communicate with the first and second outlet ports 54, 55, and the third outlet port 56 is isolated from both the supply and return lines 41, 42.

The position of the spool is controlled by controlling the fluid pressure within a control chamber 57 to which an end surface of the spool is exposed. The control chamber 57 communicates with the control chamber 46, and the pressure therein is controlled by the valve 50.

A piston member 58 is slidable within an extension of the bore within which the spool of the HITW control valve is slidable. The piston member 58 is moveable under the influence of the fluid pressure applied thereto through a passage 59 which communicates with the control chambers 46, 57 of the control circuit associated with the other bank of actuators. The piston member 58 is moveable, upon the application of fluid under high pressure to the passage 59, into engagement with the spool of the HITW control valve to move the spool against the action of the spring biasing.

Figure 3:
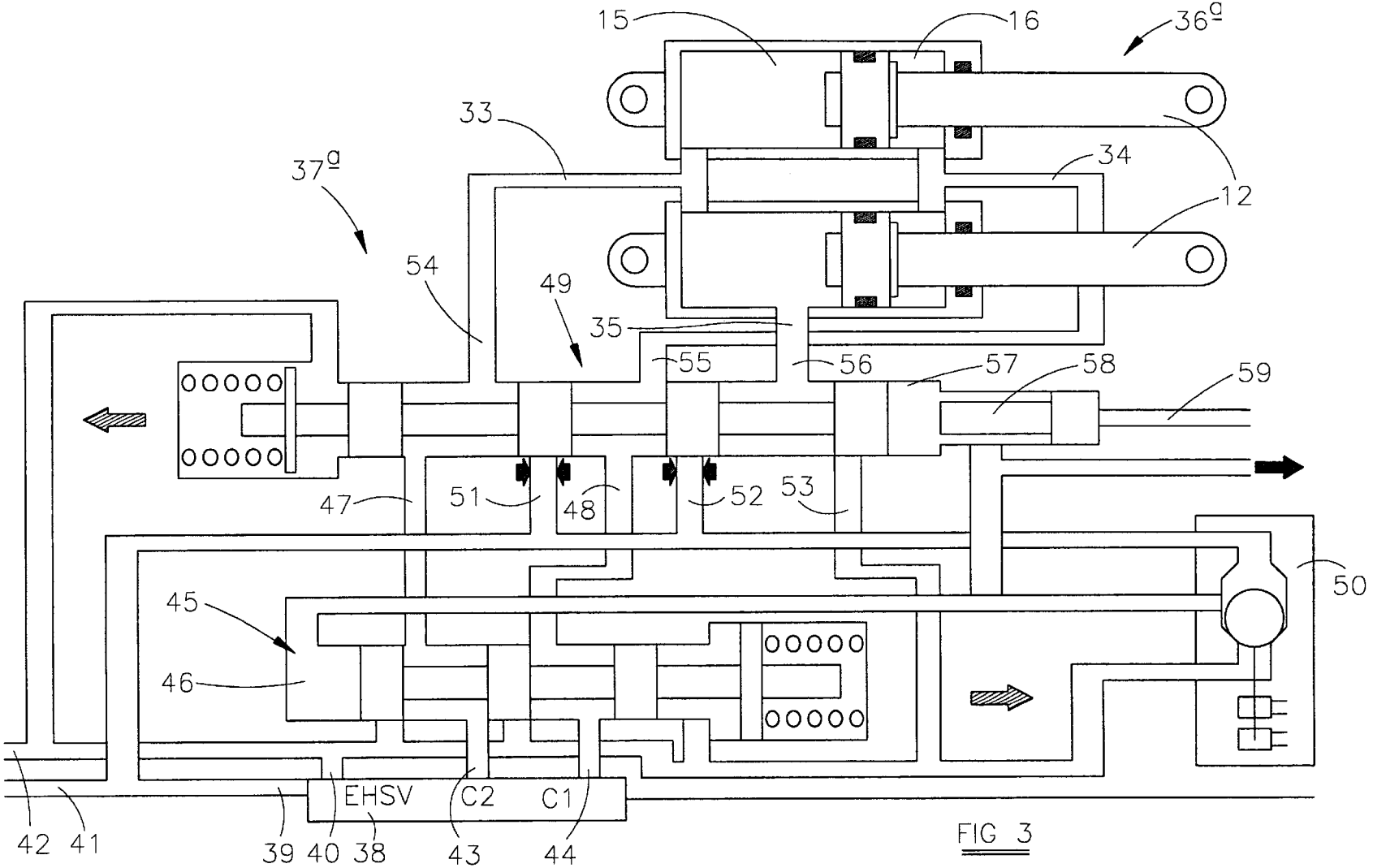
FIGS. 3, 4 and 5 are enlarged views illustrating one of the circuits of FIG. 2, in use.

FIG. 3 illustrates the control circuit 37*a* where the solenoid valve of the control circuit 37*b* is deenergised, thus the passage 59 communicates with the return line and is at relatively low pressure. The solenoid valve of the control circuit 37*a* is energised, thus the control chambers 46, 57 of the by-pass and HITW control valves are at high pressure. In these circumstances, the first and second chambers 15, 16 of the actuators associated with the control circuit 37*a* are supplied with fluid under the control of the valve 38. Thus, if the first chamber 15 is connected to the supply line 41 and the second chamber 16 is connected to the return line 42, the piston member 12 of each actuator will occupy a right hand end position and each actuator will be extended. Operation of the valve 38 to switch the fluid connections to each actuator will result in each actuator moving to a retracted position.

Although in the description hereinbefore, the solenoid valve of the control circuit 37*b* is deenergised, it will be appreciated that as the spool of the HITW control valve is already held against the action of the spring biasing by the fluid pressure within the control chamber 57, energisation of the solenoid valve of the control circuit 37*b* so that both solenoid control valves are energised will not cause movement of the spool of the HITW control valve 49 and so will not have an effect upon the operation of the circuit.

Figure 4:
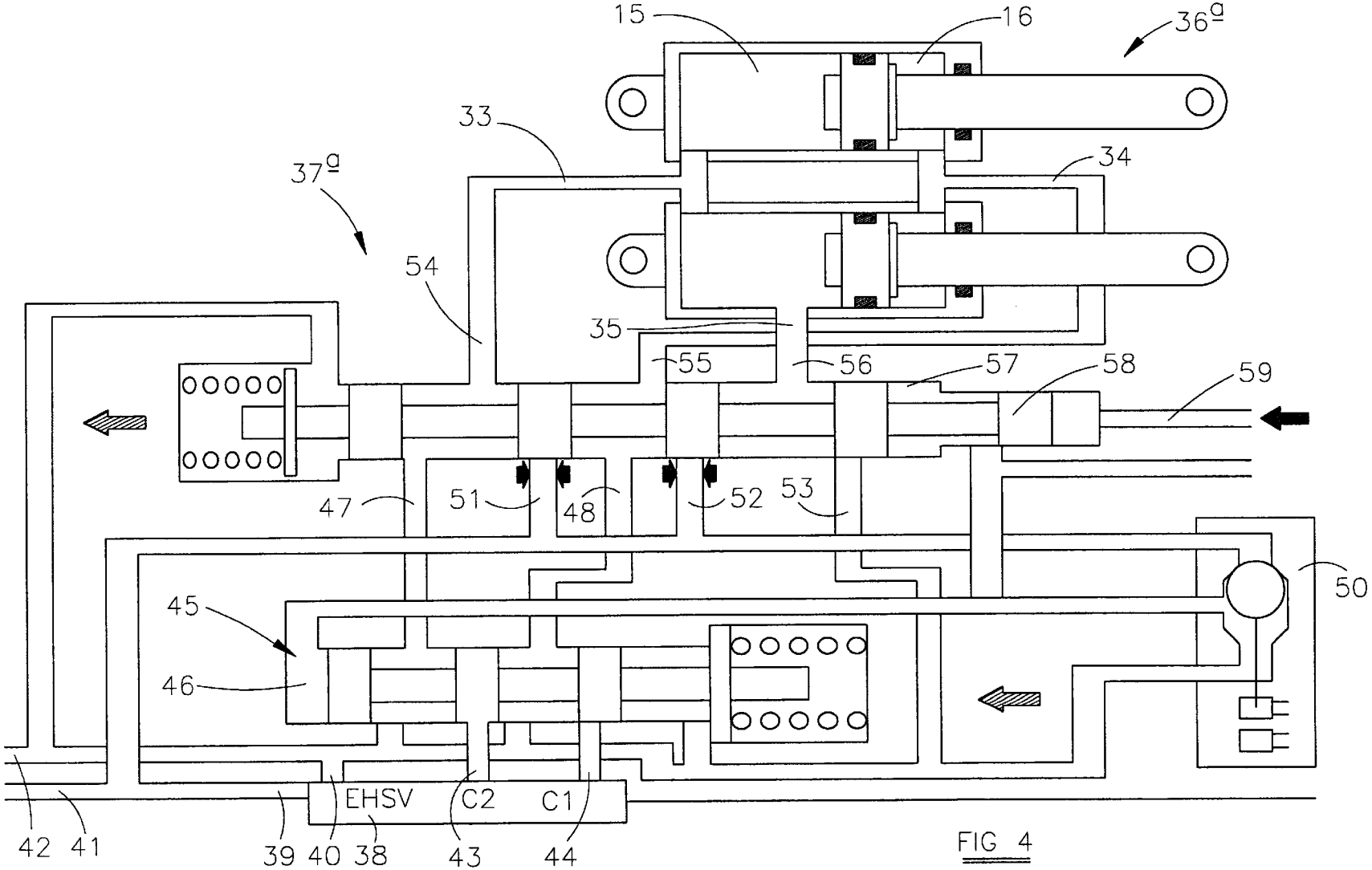

If the solenoid valve of the control circuit 37*a* is deenergised but that of the control circuit 37*b* is energised, then as shown in FIG. 4, the control chambers 46, 57 are connected to the return line 42 and thus are at low pressure. The spool of the by-pass valve moves under the action of its spring biasing to connect both inlet ports 47, 48 of the HITW control valve 49 to the return line 42. The fluid pressure applied to the passage 59 ensures that the spool of the HITW control valve 49 is held against its spring biasing, thus both the first and second chambers 15, 16 of each actuator are supplied with fluid under relatively low pressure. The piston members 12 are thus free to move, but are not positively driven to any position by the fluid pressures applied to the actuators. If the actuators associated with the control circuit 37*a* are used to drive the same component as the actuators associated with the circuit 37*b,* then the operation of the circuit 37*b* to extend or retract the actuators associated therewith will result in movement of the actuators associated with the circuit 37*b.*

Figure 5:
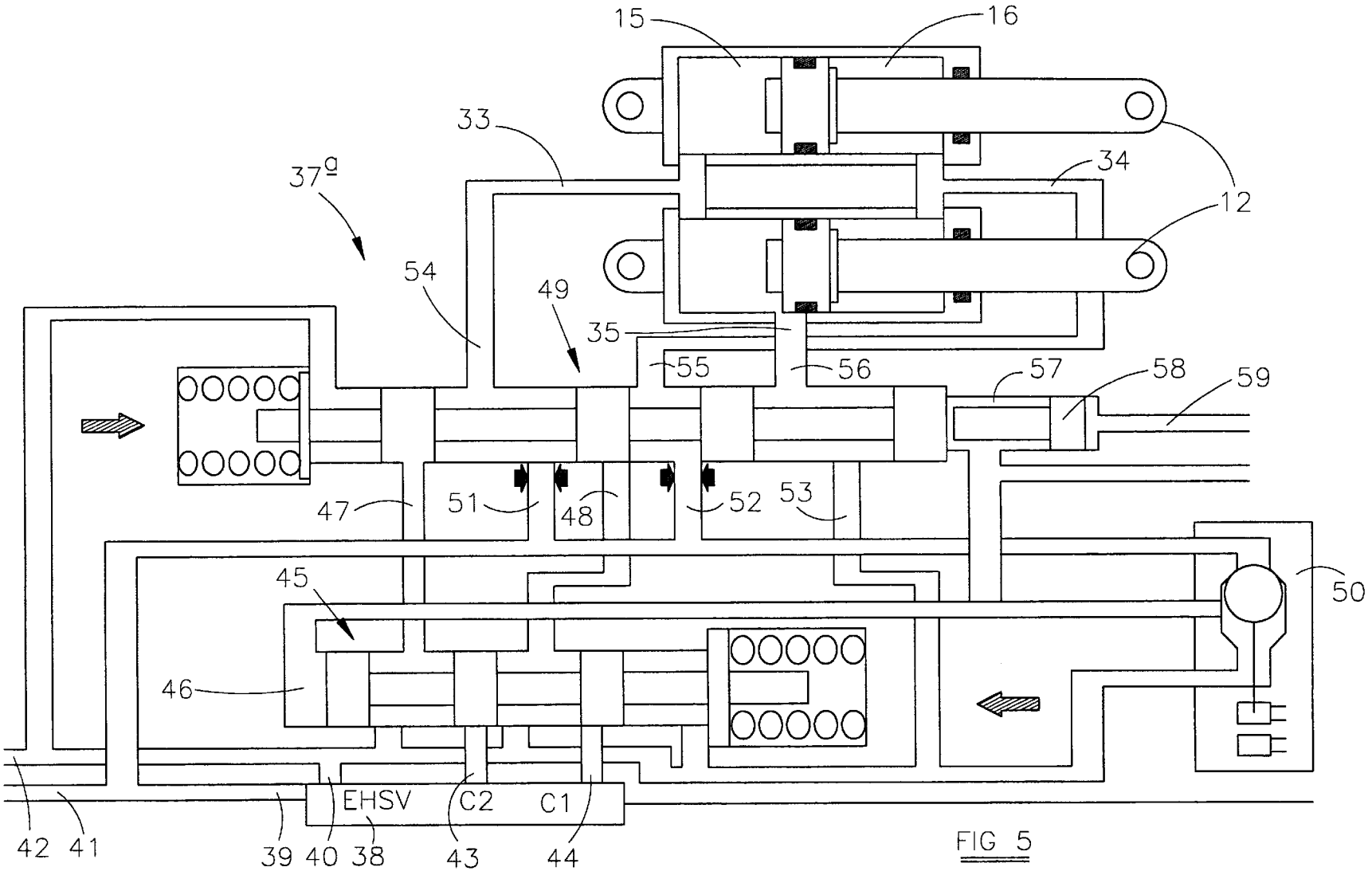

In the event of an electrical failure, as shown in FIG. 5, both of the solenoid control valves will be de-energised. In these circumstances, the control chambers 46, 57 are connected to the return line 42 and so are at relatively low pressure, and the pressure within the passage 59 is low. The spools of both the on/off valve 45 and the HITW control valve 49 move under the action of the spring biasing resulting in the first and second chambers 15, 16 of each actuator being connected through the HITW control valve 49 to the supply line 41 and in the third port 35 communicating with the return line 42.

If, in such circumstances, the piston member 12 occupies a position in which the third port 35 communicates with the second chamber 16, then as the fluid pressure within the first chamber 15 will be greater than that within the second chamber 16, the piston member 12 will move under the action of the fluid pressures until the piston member reaches a position in which the third port 35 communicates with the first chamber 15.

Where the third port 35 communicates with the first chamber 15, it will be appreciated that, as the effective area of the piston member 12 exposed to the fluid pressure within the first chamber 15 is greater than that exposed to the fluid pressure within the second chamber 16, if the chambers 15, 16 were at the same pressure as one another, a net force would be applied to the piston member urging the piston member towards its extended position. However, as the third port communicates with the first chamber 15, the first chamber 15 is at a reduced pressure, the pressure being governed by the magnitude of the restriction formed by the port 51 and by the throttling effect resulting from the cooperation between the third port 35 and the piston head arrangement 27, 28 of the piston member 12. The piston member 12 will tend towards a position in which the forces applied thereto by the fluid within the first and second chambers 15, 16 are balanced, compensating for the difference in the effective areas and relatively high external loads.

The third port 35 is located such that, in such a mode of operation, the piston member 12 of each actuator will move towards and subsequently be held in a desired intermediate position, against the action of the relatively large magnitude external loads.

Figure 1:
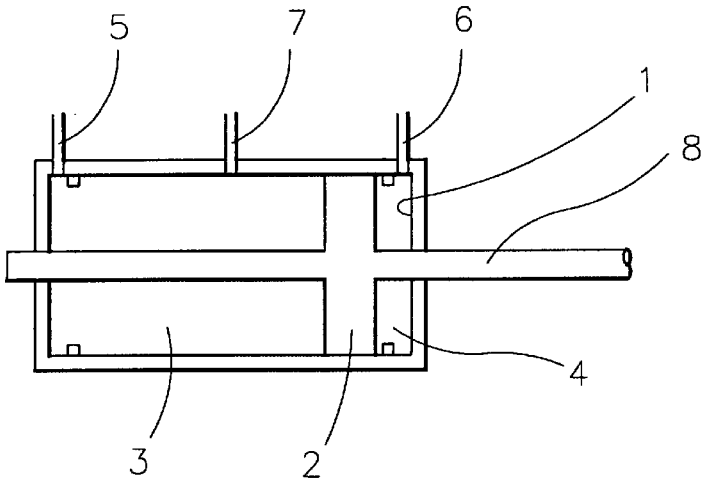
FIG. 1 is a diagrammatic view of a typical flight control HITW actuator.
Figure 7:
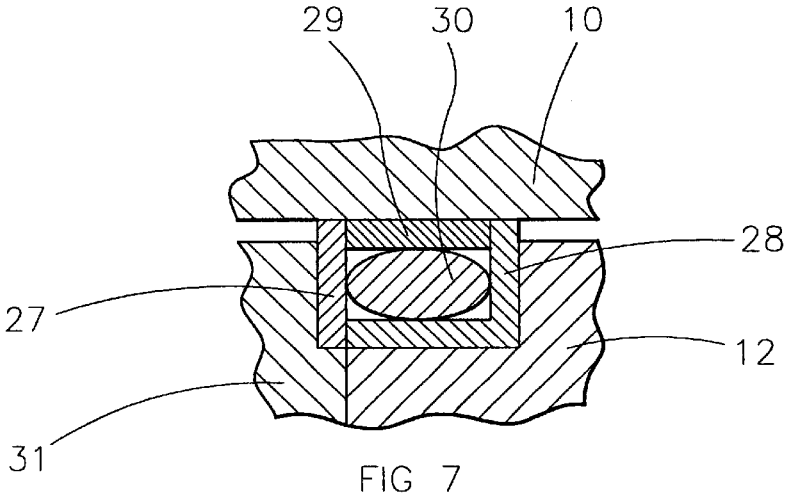
FIGS. 7, 8, 9*a* and 9*b* are diagrammatic sectional views illustrating possible seal arrangements.
Figure 8:
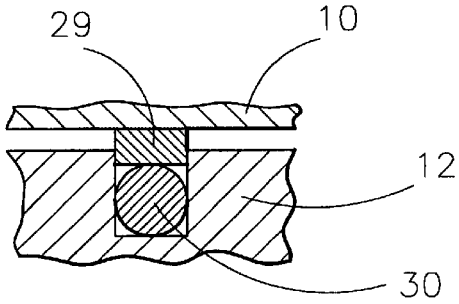

It will be appreciated that, in order for the piston head arrangement 27, 28 and third port 35 to form a reliable throttle, the piston head arrangement 27, 28 must have durable edges. This is achieved in the embodiment described hereinbefore by using metallic aluminium bronze members 27, 28 to define metering edges which cooperate with the third port 35 in such a manner that the axial position occupied by the piston member 12 controls the rate at which fluid is able to escape from the first or second chambers 15, 16 depending upon the nature of the applied load. In the arrangement of FIG. 7, the aluminium bronze alloy members 27, 28 are shaped to permit their introduction into an annular groove or recess provided in the piston member. In FIG. 8, the members 27, 28 are omitted, and instead a PEEK cap member 29 is provided which encircles the seal member 30. In this alternative, the PEEK cap 29 forms the primary metering edges which cooperate with the third port 35 to control the rate of fluid flow.

Figure 9A:
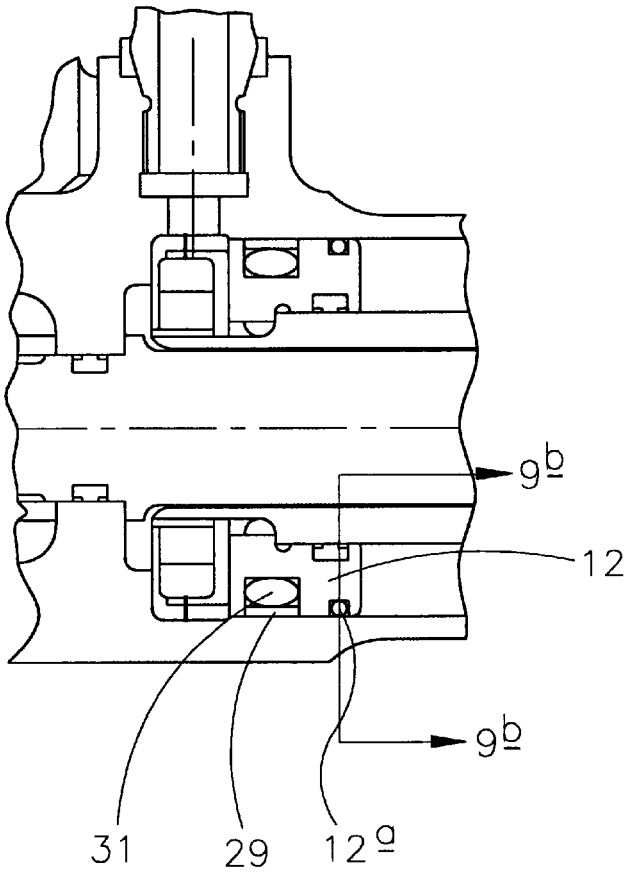
Figure 9B:
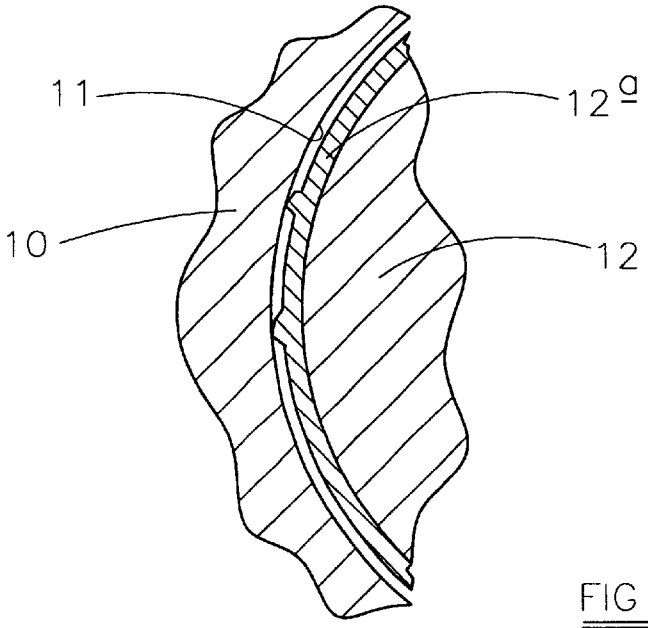

In the embodiment of FIG. 7, the piston head arrangement 27, 28, 29 acts both to define the bearing surfaces for the piston member 12 and as the seals which define the metering edges. FIGS. 9*a* and 9*b* illustrate a different piston head arrangement in which an additional, castellated bearing member 12a is carried by the piston member 12, the bearing member 12*a* taking the form of an aluminium bronze alloy ring which is castellated to defining openings whereby fluid can flow towards the metering edges of a seal of the type described hereinbefore. The arrangement shown in FIGS. 9*a* and 9*b* is for use with the seal arrangement in FIG. 8, which does not have a bearing feature integral with the seal assembly.

We claim:

1. An actuator comprising a piston slidable within a cylinder, the piston member defining with the cylinder a first chamber and a second chamber, said piston member being provided with a seal arrangement, forming a seal between said piston member and said cylinder, the effective cross-sectional area of said piston member exposed to the fluid pressure within said first chamber being greater than that exposed to the fluid pressure within the second chamber, first and second ports whereby fluid can be supplied to said first and second chambers, respectively, and a third port located intermediate said first and second ports, wherein said seal arrangement has both a sealing element and at least one bearing member, the bearing member providing a durable bearing surface which defines a metering edge which is co-operable with said third port to throttle the rate at which fluid is able to escape from said first and second chambers through said third port, in use.

2. The actuator as claimed in claim 1, the actuator being arranged such that, when the third port is connected to a source of fluid at relatively low pressure and the first and second ports are supplied with fluid at high pressure, the piston member will move towards and be held in a position in which the third port communicates with the first chamber, the position of the piston member being such that fluid is able to escape from the first chamber at a sufficiently high rate that the pressure within the first chamber is different from that within the second chamber.

3. The actuator as claimed in claim 1, wherein the seal arrangement comprises an annular member which defines the metering edge.

4. The actuator as claimed in claim 3, wherein the seal arrangement comprises a cap member located radially outward of the seal member and arranged to engage an inner surface of the cylinder.

5. The actuator as claimed in claim 3, wherein the annular member is shaped to permit introduction into an annular groove provided in the piston member.

6. The actuator as claimed in claim 3, wherein the annular member is formed from aluminum bronze or PEEK.

7. The actuator as claimed in claim 1, wherein the seal arrangement comprises a cap member which defines the metering edge.

8. The actuator as claimed in claim 7, wherein the cap member is formed from PEEK.

9. The actuator as claimed in claim 1, wherein the seal arrangement defines a bearing surface for the piston member.

10. An actuator comprising a piston slidable within a cylinder, the piston member defining with the cylinder a first chamber and a second chamber, said piston member being provided with a seal arrangement, forming a seal between said piston member and said cylinder, the effective cross-sectional area of said piston member exposed to the fluid pressure within the first chamber being greater than that exposed to the fluid pressure within the second chamber, first and second ports whereby fluid can be supplied to said first and second chambers, respectively, and a third port located intermediate the first and second ports, said seal arrangement defining a metering edge which co-operates with said third port to throttle the rate of fluid flow to the third port, said piston member further including a bearing member defining a bearing surface for the piston member and defining openings to permit fluid flow towards the metering edge.

11. The actuator as claimed in claim 10, the actuator being arranged such that, when the third port is connected to a source of fluid at relatively low pressure and the first and second ports are supplied with fluid at high pressure, the piston member will move towards and be held in a position in which the third port communicates with the first chamber, the position of the piston member being such that fluid is able to escape from the first chamber at a sufficiently high rate that the pressure within the first chamber is different from that within the second chamber.

12. The actuator as claimed in claim 10, wherein the seal arrangement comprises a seal member.

13. The actuator as claimed in claim 10, wherein the seal arrangement comprises an annular member which defines the metering edge.

14. The actuator as claimed in claim 13, wherein the seal arrangement comprises a cap member located radially outward of the seal member and arranged to engage an inner surface of the cylinder.

15. The actuator as claimed in claim 13, wherein the annular member is shaped to permit introduction into an annular groove provided in the piston member.

16. The actuator as claimed in claim 13, wherein the annular member is formed from aluminum bronze or PEEK.

17. The actuator as claimed in claim 10, wherein the seal arrangement comprises a cap member which defines the metering edge.

18. The actuator as claimed in claim 17, wherein the cap member is formed from PEEK.

19. An actuator comprising a piston slidable within a cylinder, the piston member defining with the cylinder a first chamber and a second chamber, said piston member being provided with a seal arrangement, forming a seal between said piston member and said cylinder, the effective cross-sectional area of said piston member exposed to the fluid pressure within the first chamber being greater than that exposed to the fluid pressure within the second chamber, respectively, and a third port located intermediate the first and second ports, said seal arrangement comprising an annular member formed from aluminum bronze or PEEK and which defines a metering edge which co-operates with said third port to throttle the rate of fluid flow to the third port.

20. An actuator comprising a piston slidable within a cylinder, the piston member defining with the cylinder a first chamber and a second chamber, said piston member being provided with a seal arrangement, forming a seal between said piston member and said cylinder, the effective cross-sectional area of said piston member exposed to the fluid pressure within the first chamber being greater than that exposed to the fluid pressure within the second chamber, first and second ports whereby fluid can be supplied to said first and second chambers, respectively, and a third port located intermediate the first and second ports, said seal arrangement comprising a cap member formed from PEEK which defines a metering edge and which co-operates with said third port to throttle the rate of fluid flow to third port.

* * * * *